US011565855B2

(12) United States Patent
Zhu et al.

(10) Patent No.: US 11,565,855 B2
(45) Date of Patent: Jan. 31, 2023

(54) LID FOR A CONTAINER

(71) Applicant: Huhtamäki Oyj, Espoo (FI)

(72) Inventors: Yueping Zhu, Dongguan (CN); Chen Shubin, Beijing (CN)

(73) Assignee: HUHTAMAKI OYJ, Espoo (FI)

( * ) Notice: Subject to any disclaimer, the term of this patent is extended or adjusted under 35 U.S.C. 154(b) by 0 days.

(21) Appl. No.: 17/132,453

(22) Filed: Dec. 23, 2020

(65) Prior Publication Data

US 2021/0198014 A1 Jul. 1, 2021

(30) Foreign Application Priority Data

Dec. 27, 2019 (EP) ..... 19219808

(51) Int. Cl.
*B65D 43/02* (2006.01)
*B65D 77/20* (2006.01)

(52) U.S. Cl.
CPC ..... *B65D 43/0212* (2013.01); *B65D 77/206* (2013.01); *B65D 2543/00046* (2013.01); *B65D 2543/0074* (2013.01); *B65D 2543/00092* (2013.01); *B65D 2543/00231* (2013.01); *B65D 2543/00268* (2013.01); *B65D 2543/00314* (2013.01); *B65D 2543/00527* (2013.01); *B65D 2543/00537* (2013.01); *B65D 2543/00796* (2013.01); *B65D 2543/00805* (2013.01)

(58) Field of Classification Search
CPC ..... B65D 77/206; B65D 2543/00314; B65D 2543/00268; B65D 43/0212; B65D 2543/00046
See application file for complete search history.

(56) References Cited

U.S. PATENT DOCUMENTS

| | | | | |
|---|---|---|---|---|
| 2,125,609 | A | 8/1938 | Goodwin | |
| 3,317,068 | A * | 5/1967 | Betner | B65D 77/208 215/233 |
| 4,673,126 | A * | 6/1987 | Hambleton | B65D 5/706 220/255.1 |
| 4,762,246 | A * | 8/1988 | Ashley | B32B 7/12 220/270 |
| 2004/0013827 | A1 | 1/2004 | Zuser et al. | |
| 2006/0289542 | A1 * | 12/2006 | Schedl | B29C 66/91421 220/359.2 |

(Continued)

FOREIGN PATENT DOCUMENTS

| | | | |
|---|---|---|---|
| JP | H0986572 | A | 3/1997 |
| JP | 2000203654 | A | 7/2000 |
| WO | 2016069755 | A1 | 5/2016 |

OTHER PUBLICATIONS www.https://hasolid.com/the-lid, 3 pages, 2021 Haso Ltd. Accessed Feb. 17, 2021.

*Primary Examiner* — Jeffrey R Allen
(74) *Attorney, Agent, or Firm* — Husch Blackwell LLP

(57) ABSTRACT

A lid for a container, such as a beverage cup, is provided. The lid includes a top wall for covering an opening of the container. The top wall may include an inner layer and an outer layer. The inner layer may include a first perforation line defining an openable sip hole area. The outer layer may be connected to the inner layer at the openable sip hole area. The outer layer may include a tearing off area that may be torn off and result in the opening of the first perforation line to create a sip hole in the inner layer.

20 Claims, 12 Drawing Sheets

(56) References Cited

U.S. PATENT DOCUMENTS

| | | | | |
|---|---|---|---|---|
| 2010/0176130 | A1* | 7/2010 | Kim | B65D 51/245 220/254.1 |
| 2016/0096667 | A1* | 4/2016 | Huffer | B65D 75/5894 220/257.2 |
| 2018/0170642 | A1 | 6/2018 | Dugonjic et al. | |

* cited by examiner

LID FOR A CONTAINER

CROSS-REFERENCE TO RELATED APPLICATION

This Application claims priority to European Patent Application Number 19219808.3 filed Dec. 27, 2019, to Yueping Zhu et al., titled "A lid for a container", currently pending, the entire disclosure of which is incorporated herein by reference.

FIELD OF THE INVENTION

The invention is directed to a lid for a container, such as a beverage cup, comprising a top wall for covering an opening of the container. The invention is further directed to a method for manufacturing a lid for a container. The invention is further directed to a package comprising a container, such as a beverage cup, and a lid.

BACKGROUND OF THE INVENTION

Containers in the form of beverage cups are often provided with lids to reduce the risk of spilling a beverage that is held in the container. These lids may additionally help to inhibit undesired cooling of hot beverages held in the container.

An exemplary paper lid for a beverage cup is known from www.hasolid.com. This lid has a top wall made from a single layer of coated paper and includes a sip hole area that is defined by a perforation line in the paper layer. A paper strip is attached to the sip hole area, which paper strip can be pulled by a user to open the perforation line. This lid suffers from the problem that the paper strip can break or get detached prior to opening the sip hole, e.g. because it is affected by contact with a beverage. Without the paper strip it is hardly possible to open the sip hole. In addition, such lids with a single layer top wall, typically are susceptible to leakage in the area of the sip hole, in particular at the perforation line.

Accordingly, a need exists for a lid for a container that is less susceptible to leakage and that includes a sip hole that can be opened reliably.

SUMMARY OF THE INVENTION

The present invention is directed generally toward a lid for a container, such as a beverage cup, comprising a top wall for covering an opening of the container, wherein the top wall may comprise an inner layer and an outer layer, wherein the inner layer may comprise a first perforation line defining an openable sip hole area, and wherein the outer layer may be connected to the inner layer at the openable sip hole area so that tearing off at least a part of the outer layer results in opening of the first perforation line to create a sip hole in the inner layer.

The inventive lid may comprise a multi-layered top wall structure with an inner layer that, during use of the lid with a container, may be disposed to be directed toward the interior of the container, and with an outer layer that, during use of the lid with a container, may be directed away from the interior of the container. The layer may be made from a recyclable material. The inner layer may comprise a sip hole area that may be defined by the perforation line such that opening the perforation line results in creating a sip hole in the inner layer of the top wall. This sip hole may also be referred to as a drinking hole. The outer layer may be connected to the inner layer in the sip hole area so that tearing of the outer layer, in particular the portion of the outer layer that is connected to the sip hole area of the inner layer, may result in tearing off the sip hole area away from the rest of the inner layer in a direction away from interior of the container. This may result in opening of the perforation line and creating a sip hole in the inner layer. The inventive lid does not require a separate paper strip to be connected to the outside of the top wall. Consequently, the sip hole in the inner layer can be reliably opened by tearing off the outer layer of the top wall of the lid. The lid of the present invention may be in contrast to lids currently known in the prior art that include a top wall that consists solely of a single layer. Accordingly, the lid of the present invention may reduce the risk of unwanted leakage in the area of the sip hole.

According to one embodiment of the invention, the outer layer may be connected to the inner layer at the openable sip hole area by an adhesive bond. The adhesive bond may be formed by a glue. The glue can be at the entirety of the sip hole area or only at a part thereof. According to one embodiment, the glue may be provided to at least half of the sip hole area. Alternatively, or additionally, the outer layer may be connected to the inner layer at the openable sip hole area by a heat-sealed connection. The heat-sealed connection may be provided at the entirety of the sip hole area or only at a part thereof. According to one embodiment, the heat-sealed connection may be provided to at least at half of the sip hole area. Further alternatively or additionally, the outer layer may be connected to the inner layer at the openable sip hole area by a welded joint, including without limitation, an ultrasonic welded joint. The welded joint may be provided at the entirety of the sip hole area or only at a part thereof. According to one embodiment, the welded joint may be provided to at least half of the sip hole area.

According to one embodiment of the invention, the outer layer may not be connected to the inner layer in an area surrounding the openable sip hole area. The inner layer may contact the outer layer in the area surrounding the openable sip hole area without being connected or joined to the outer layer. Between the inner layer and the outer layer, an air gap may be formed that can improve thermal isolation by the top wall of the lid. According to one embodiment, in the area surrounding the sip hole area, the inner layer and the outer layer are not connected by an adhesive bond and/or not connected by a heat-sealed connection and/or not connected by a welded joint.

According to one embodiment of the invention, the outer layer is not connected to the inner layer in the area of the first perforation line that defines the openable sip hole area. The inner layer may contact the outer layer in the area of the first perforation line without being connected or joined to the outer layer. The inner layer may additionally be connected to the outer layer in an area surrounding the first perforation line by an additional connection area. For example, according to one embodiment, the inner layer and the outer layer may be connected by a connection area in the form of a connection line that runs in parallel to the first perforation line, e.g. a curved line and/or a U-shaped line. In the additional connection area, the inner layer and the outer layer may be connected by an adhesive bond and/or connected by a heat-sealed connection and/or connected by a welded joint.

According to one embodiment of the invention, the outer layer may be connected to the inner layer at the edge, in particular the perimeter, of the outer layer by an adhesive bond and/or connected by a heat-sealed connection and/or connected by a welded joint. The connection at the edge may include a ring-shaped connection area or several connection areas that are situated on a virtual ring.

According to one embodiment of the invention, the outer layer may comprise a second perforation line defining a tear-off area. The tear-off area of the outer layer may be connected to the openable sip hole area of the inner layer so that both the tear-off area and the sip hole area may be torn off together from the top wall of the lid in order to create the sip hole. The second perforation line may be a closed perforation line, such as an oval perforation line or circular perforation line, so that the tear-off area can be completely removed from the outer layer of the top wall of the lid.

According to one embodiment of the invention, the second perforation line may have a third and a fourth perforation line end, wherein the ends of the third and the fourth perforation line can connect to a common second crease line. According to this embodiment, a tear-off area may be defined, that is able to be partly removed from the outer layer and partly connected to the outer layer via the second crease line. The second crease line may be created by hemming the outer layer. The inner layer may either include a first perforation line in the form of a closed perforation line or a first perforation line that connects to a first crease line (thereby combining the first perforation line and the first crease line to define the openable sip hole area).

According to one embodiment of the invention, the outer layer may comprise a tear-off area that is at least partly defined by a cut line and/or a cut-out. The cut-out may also serve as a gripping recess. The tear-off area of the outer layer may be connected to the openable sip hole area of the inner layer so that both the tear-off area and the sip hole area may be torn off together from the top wall of the lid in order to create the sip hole. The tear-off area may be defined by the cut line and/or cut-out together with a crease line.

According to one embodiment of the invention, the tear-off area may be larger than the sip hole area. Configuring the tear-off area of the outer layer to be larger than the openable sip hole area of the inner layer may ensure that the tear-off layer is sufficiently connected to the sip hole area and at the same time provides a grabbing area (i.e., that part of the tear-off area that is not connected to the openable sip hole area), which can be grabbed by a finger of a user. The tear-off area may be arranged to completely cover the sip hole area. For example, a first center point of the sip hole area in the inner layer may be arranged to overlap a second center point of the tear-off area in the outer layer. The tear-off area and the openable sip hole area may be aligned such that a grabbing area (i.e., that part of the tear-off area that is not connected to the openable sip hole area) surrounds the part of the tear-off area that is connected to the openable sip hole area.

According to one embodiment of the invention, the outer layer may comprise a grip recess that may be arranged adjacent the tear-off area. The grip recess may be provided as a hole in the outer layer covering the inner layer in an area surrounding the openable sip hole area. The grip recess may enable a finger of a user to be introduced into the grip recess in order to simplify removal of the tear-off area starting from the grip recess. When introducing the finger into the grip recess, the finger may touch the inner layer and an edge of the tear-off area of the outer layer. The finger may bend the edge of the tear-off area away from the inner layer so that the finger may be introduced in between the tear-off area and the inner layer so that the tear-off area of the outer layer may be torn off.

According to one embodiment of the invention, the outer layer may comprise an intermediate crease line situated in the tear-off area, wherein the second perforation line and the intermediate crease line define a gripping tab. The gripping tab may be gripped by a finger approaching the tear-off area from the grip-recess. According to such an embodiment, the gripping tab may facilitate the tearing off of the tear-off area.

According to one embodiment of the invention, the openable sip hole area of the inner layer may be arranged within in a distance from the grip recess. According to certain embodiments, the distance may be at least 1 mm, at least 2 mm, or at least 3 mm. According to one embodiment, the tear-off area is not connected to the inner layer in the area surrounding the openable sip hole area, namely the grabbing area. Thus, the grabbing area may be grabbed and the tear-off area of the outer layer may be conveniently torn off.

According to one embodiment of the invention, the first perforation line, in a section of the openable sip hole area facing the grip recess, may comprise a larger perforation element than in a section of the openable sip hole area oriented away from the grip recess. According to such an embodiment, tearing off the openable sip hole area starting from the direction of the grip recess may be facilitated. The perforation element of the first perforation line may be a cut line or a through hole in the inner layer.

According to one embodiment of the invention, the first perforation line may be a closed perforation line. This embodiment provides the possibility to completely remove the openable sip hole area from the inner layer when the closed perforation line is completely broken. The closed perforation line may be provided in the form of an oval perforation line or a circular perforation line so that an oval or circular sip hole can be created by removing the openable sip hole area. Such oval or circular sip hole may allow to conveniently drink a beverage through the sip hole without the risk of spilling the beverage.

According to one embodiment of the invention, the first perforation line may have a first and a second perforation line end, wherein the first and the second perforation line ends can connect to a common first crease line. According to such an embodiment, a openable sip hole area may be defined, that is able to be partly removed from the inner layer and partly connected to the inner layer via the first crease line. The first crease line may be created by hemming the inner layer.

According to one embodiment of the invention, the outer layer may comprise a slot arranged so that a portion of the tear-off area may be inserted into the slot after separating the portion from the outer layer. By inserting the portion of the tear-off area into the slot, the portion may be arranged so as to rest between the inner layer and the outer layer. This arrangement may facilitate convenient drinking through the sip hole when the portion of the tear-off area is inserted into the slot. According to one embodiment, the slot is arranged in parallel to the second crease line in the outer layer and/or in parallel to the first crease line in the inner layer. The slot may have a width and two endings, wherein the width of the slot may be smaller at the endings than at the middle of the slot in between the endings. This may facilitate introducing the portion of the tear-off area into the slot.

According to one embodiment of the invention, the lid may comprise a sidewall arranged at an angle with respect to the top wall, wherein both the inner layer and the outer layer of the top wall may be connected to the sidewall. The sidewall may be a conical sidewall and the angle of the sidewall may be an acute angle. Alternatively, the sidewall may be a cylindrical sidewall and the angle of the sidewall may be a 90° angle. The top wall may be circular and the sidewall may define a circular rim.

The sidewall of the lid may comprise a first bent edge. According to one embodiment, both the inner layer and the outer layer of the top wall may be wrapped by the first bent edge. According to such an embodiment, a rigid connection between the top wall and the sidewall may be provided. The sidewall may comprise a second bent edge that is arranged at an edge of the sidewall opposite the first bent edge. The second bend edge may provide a mouth roll to facilitate drinking. The first bent edge and/or the second bent edge may be a rolled edge.

According to one embodiment of the invention, the lid may comprise a sidewall arranged at an angle with respect to the top wall, wherein the inner layer of the top wall may be connected to the sidewall, wherein the sidewall may comprise a first bent edge, wherein the inner layer of the top wall may be wrapped by the first bent edge, and wherein the outer layer of the top wall may be a plane layer that may be connected to a surface of the inner layer facing the outer layer, and wherein the plane layer is optionally not connected to the sidewall.

According to one embodiment, the lid may comprise a sidewall arranged at an angle with respect to the top wall, wherein the outer layer of the top wall may be connected to the sidewall, wherein the sidewall may comprise a first bent edge, wherein the outer layer of the top wall may be wrapped by the first bent edge, wherein the inner layer of the top wall may be a plane layer that may be connected to a surface of the outer layer facing the inner layer, and wherein the plane layer is optionally not connected to the sidewall.

According to one embodiment of the invention, the sidewall may comprise a bead in the form of an annular protrusion. Using the bead, the lid may be locked at the mouth roll of a cup the lid is attached to. The protrusion may be arranged with an inward-looking orientation.

According to one embodiment of the invention, the inner layer and/or the outer layer and/or the sidewall may be made from paper or cardboard, including without limitation biodegradable paper or biodegradable cardboard. For example, the inner layer and/or the outer layer and/or the sidewall may be made from coated paper or coated cardboard, including without limitation, double side coated paper or double side coated cardboard, wherein the coated paper or coated cardboard may comprise a coating including a biopolymer, such as polylactic acid (PLA), or a dispersion coating. The inner layer and/or the outer layer and/or the sidewall may be made from plastic, including without limitation, from an organic polymer.

According to one embodiment of the invention, the inner layer may include a first venting hole and the outer layer may include a second venting hole, wherein the first and second venting holes do not overlap and may be arranged within a distance from each other. The inner layer may comprise several first venting holes and/or the outer layer may comprise several second venting holes, wherein the first and second venting holes do not overlap. Alternatively, a gripping recess in the outer layer and/or a slot in the outer layer can work as a venting hole.

The present invention is a directed toward a package comprising a container, such as a beverage cup, and a lid as described before.

The present invention is further directed toward a method for manufacturing a lid for a container, such as for a beverage cup, wherein a top wall for covering an opening of the container is provided and may comprise an inner layer and an outer layer, wherein a first perforation line may be created in the first paper layer, the first perforation line defining a openable sip hole area, wherein the outer layer may be arranged on top of the inner layer, wherein the outer layer may be connected to the inner layer at the openable sip hole area so that tearing off at least a part of the outer layer may result in opening of the first perforation line to create a sip hole in the inner layer.

The package and the method of the present invention may include the lid according to the invention as described herein. The embodiments and features discussed in conjunction with the lid may, either alone or in combinations, be advantageously applied to the package and/or the method.

Other aspects and advantages of the present invention will be apparent from the following detailed description of the preferred embodiments of the accompanying drawing figures.

DESCRIPTION OF THE SEVERAL VIEWS OF THE DRAWING

In the accompanying drawings, which form a part of the specification and are to be read in conjunction therewith in which like reference numerals are used to indicate like or similar parts in the various views.

DETAILED DESCRIPTION OF THE INVENTION

Figure 1:
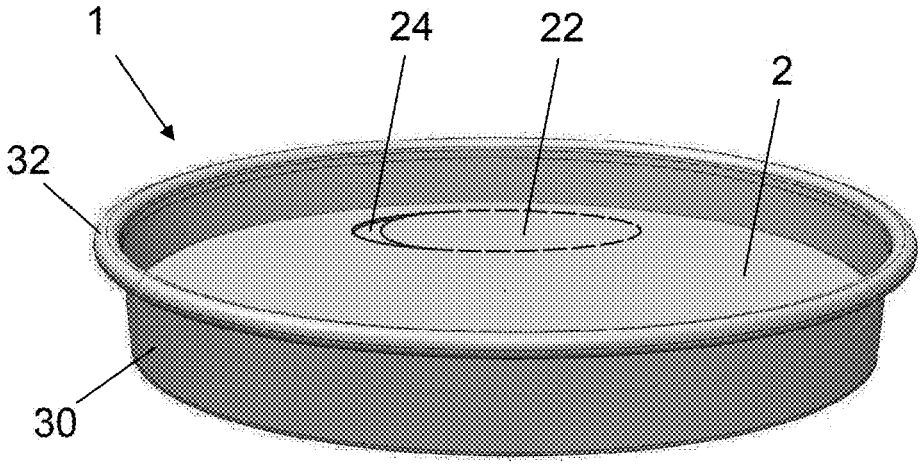
FIG. 1 is a perspective view of a lid according to a first embodiment of the invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention.

Figure 2:
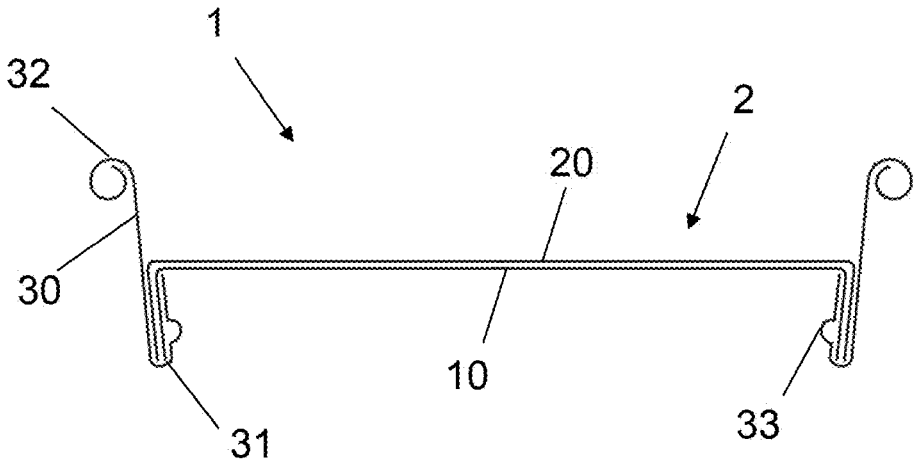
FIG. 2 is a sectional side vide of the lid according to FIG. 1.

FIGS. 1 and 2 illustrate a first embodiment of a lid 1 according to the invention. The lid 1 may comprise a top wall 2 that is suitable for covering an opening of a container, such as but not limited to, a beverage cup. The top wall 2 may have a circular shape with a perimeter that may be connected to a sidewall 30 of the lid 1. The sidewall 30 may have a top edge 32 that may be configured as a bent edge, such as a rolled edge. Additionally, the sidewall 30 may comprise a lower edge 32 that may be configured as a bent edge. According to one embodiment, the sidewall 30 may have a conical shape, wherein the diameter of the sidewall 30 is larger at the top bent edge 32 of the sidewall than at a lower bent edge 31 of the sidewall 30. Alternatively, the sidewall 30 may have a cylindrical shape, wherein the diameter of the sidewall 30 at the top bent edge 32 of the sidewall 30 is approximately equal to the diameter at a lower bent edge 31 of the sidewall 30. The top wall 2 may be bent or folded at its perimeter so as to fit adjacent to the inside of sidewall 30. The lower bent edge 31 of the sidewall may be wrapped around the perimeter of the top wall 2 and may form a connection between the top wall 2 and the sidewall 30. The sidewall 30 may comprise an inward-looking bead 33 for locking the lid 1 at a mouth roll of a container not shown in FIG. 2. The bead 33 may be configured as a protrusion in the sidewall 30. The bead 33 may be annular or may be implemented as separate protrusion elements.

According to one embodiment, the top wall 2 may be configured as a multi-layered top wall. The top wall 2 may include an inner layer 10 and an outer layer 20. When the lid 1 is connected to a container, the inner layer 10 may be directed toward the interior of the container and the outer layer 20 may be directed away from the interior of the container.

Figure 3:
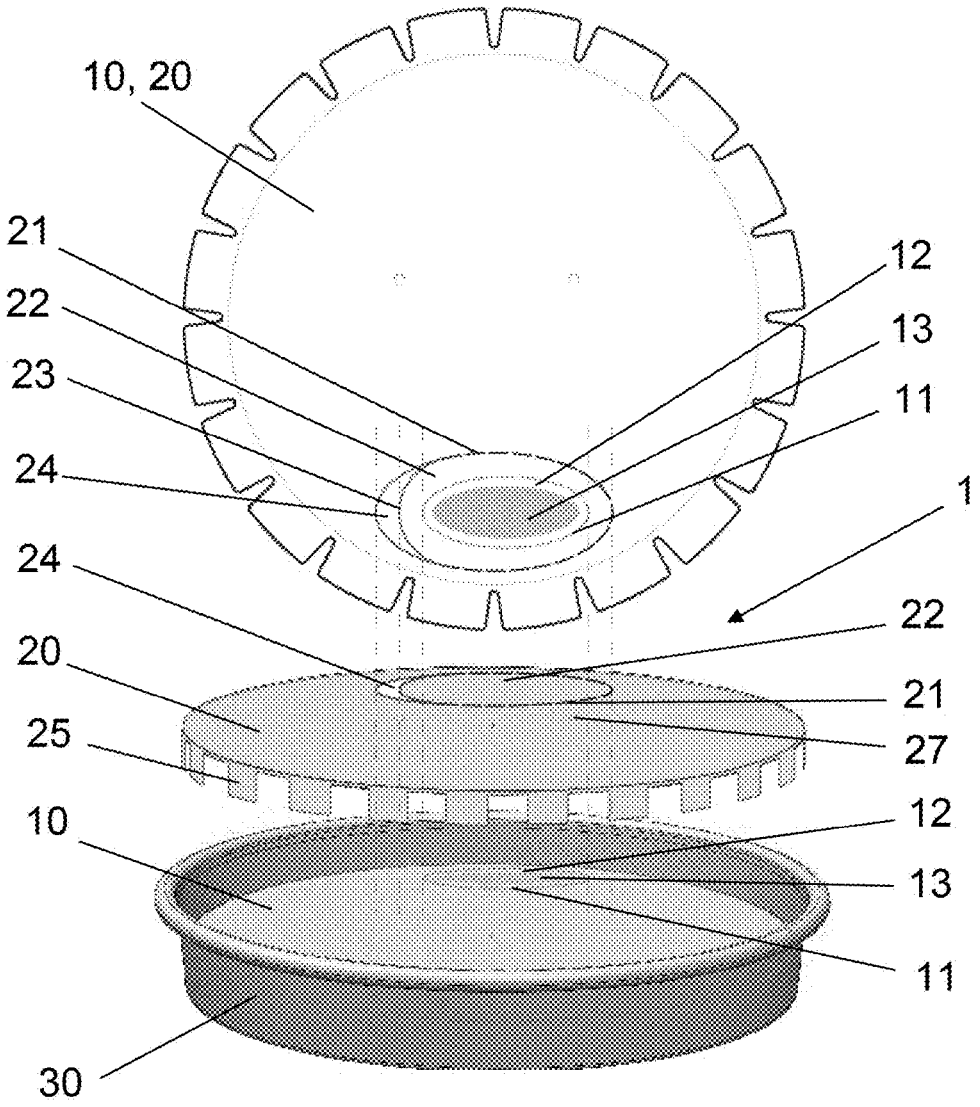
FIG. 3 is a schematic perspective view of the lid according to FIG. 1, illustrating an overlay of two layers of a top wall of the lid.

As shown in FIG. 3, the inner layer 10 of the top wall 2 may comprise a first perforation line 11 that can define an openable sip hole area 12. According to the first embodiment of the lid 1 shown in FIG. 3, the perforation line 11 may have an oval shape thereby defining an oval openable sip hole area 12. The outer layer 20 of the top wall 2 may be connected to the inner layer 10 at the openable sip hole area 12. As shown in FIG. 3, a connection 13 may be formed between the inner layer 10 and the outer layer 20 in the openable sip hole area 12. The connection 13 may be an adhesive bond and/or a heat-sealed connection and/or a welded joint (such as an ultrasonic welded joint). According to the first embodiment of lid 1 as shown in FIG. 3, the outer layer 20 may not be connected to the inner layer 10 in an area surrounding the openable sip hole area 12. In other words, the outer layer 20 may fit closely with the inner layer 10, and the outer layer 20 and the inner 10 are only connected at the openable sip hole area 12 and at the perimeter where both layers 10 and 20 are connected to the sidewall 30.

Figure 10:
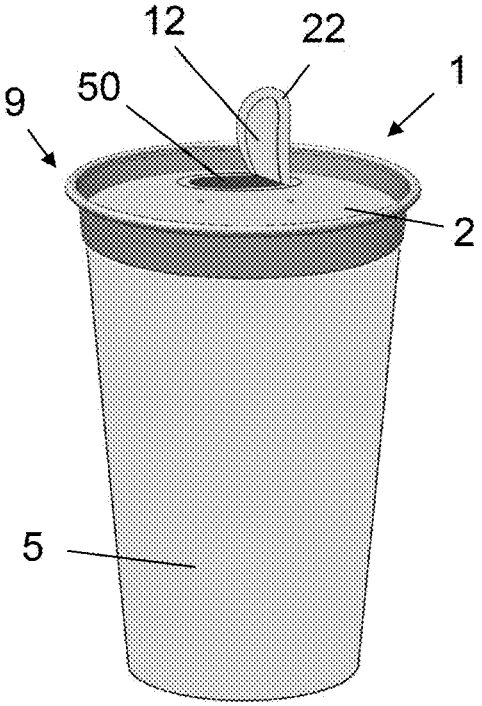
FIG. 10 is a perspective view of the package of FIG. 8, illustrating the lid in a partially opened configuration.
Figure 11:
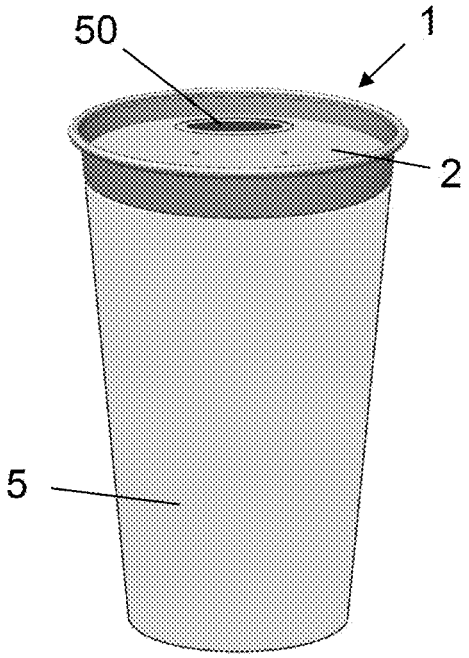
FIG. 11 is a perspective view of the package of FIG. 8, illustrating the lid in a fully opened configuration.

As further shown in FIG. 1 and FIG. 3, the outer layer 20 may include a second perforation line 21 that may define a tear-off area 22 of the outer layer 20. The second perforation line 21 may have an oval shape. The tear-off area 22 of the outer layer 20 and the openable sip hole area 12 of the inner layer 10 may be configured in an overlapping arrangement. Thus, the connection 13 between the inner layer 10 and the outer layer 20 may be provided between the tear-off area 22 and the openable sip hole area 12 so that tearing off at least a part of the tear-off area 22 may result in opening of the first perforation line 11 to create a sip hole 50 in the inner layer 10 (as shown in FIGS. 10 and 11). Both, the first perforation line 11 of the inner layer 10 and the second perforation line 21 of the outer layer 20 may be closed perforation lines. As a result, the sip hole area 12 and the tear-off area 22 can be completely removed from the top wall 2 of the lid 1 in order to create a completely opened sip hole 50 (see FIG. 11).

The tear-off area 22 and the sip hole area 12 may be arranged one above the other in a region of the respective inner and outer layers 10, 20 near the outer perimeter of the sip hole area 12. Thereby, when the sip hole area 12 is removed, a user may drink through the sip hole 50.

As shown in FIG. 3, the tear-off area 22 may be larger than the sip hole area 12. According to one embodiment, in the overlay of the inner layer 10 and the outer layer 20, the tear-off area 22 may completely cover the sip hole area 12. The center of the sip hole area 12 and the center of the tear-off area 22 may overlap at the same location. Consequently, the projection of the sip hole area 12 on the outer layer, here the tear-off area 22, may be surrounded by a grabbing area as part of the tear-off area 22. The grabbing area may the part of the tear-off area 22 that is not connected to the sip hole area 12 of the inner layer 10. The inner layer 10 and the outer layer 20 may be aligned such that the openable sip hole area 12 of the inner layer 10 is arranged within a distance from the grip recess 24. According to certain embodiments, the distance may be at least 1 mm, at least 2 mm, or at least 3 mm.

To facilitate grabbing the tear-off area 22, the outer layer 20 may further include a grip recess 24 adjacent the tear-off area 22. The grip recess 24 may be formed by cutting out a recess area and removing the recess area from the outer layer 20. The grip recess 24 may be bounded by an edge of the tear-off area 22. According to the embodiment of lid 1 as shown in FIGS. 1-3, the grip recess 24 may have an arcuate shape that is adapted to fit the outer contour of the oval tear-off area 22.

Figure 4:
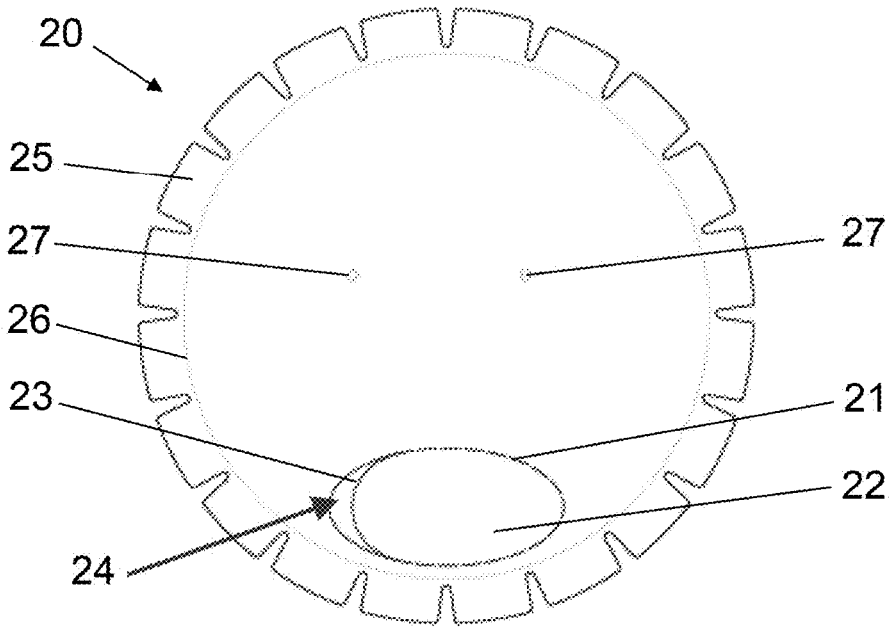
FIG. 4 is a plan view of the lid according to FIG. 1, illustrating an outer layer of a top wall of the lid.

As shown in FIG. 4, the perimeter region of the outer layer 20 may comprise a plurality of teeth 25 wherein adjacent teeth 25 are separated by notches. As shown in FIG. 3, the teeth 25 of the perimeter region may be folded or bent at a bending line 26 so that the perimeter region can be aligned in parallel to the sidewall 30 for connecting the outer layer 20 to the sidewall 30.

Figure 5:
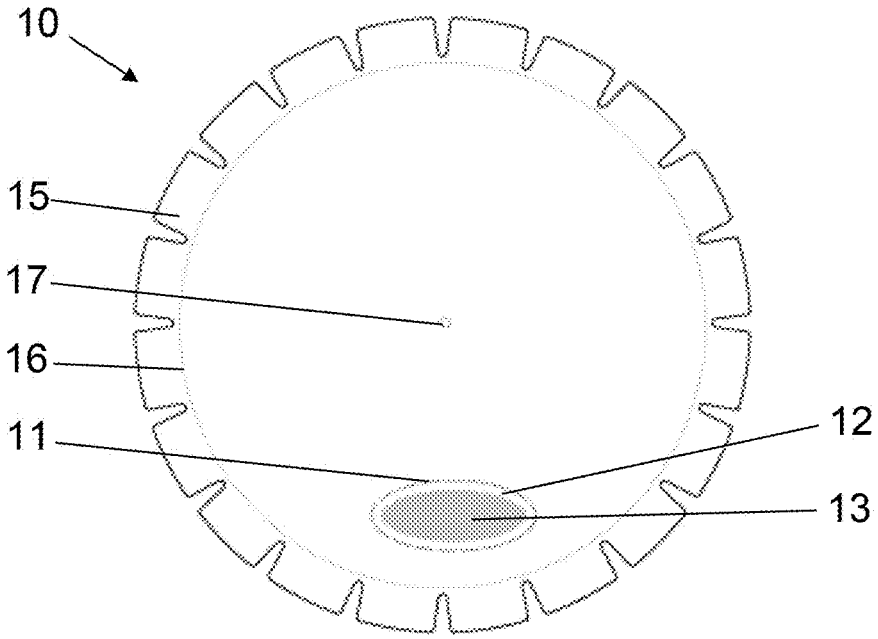
FIG. 5 is a plan view of the lid according to FIG. 1, illustrating an inner layer of a top wall of the lid.

As shown in FIG. 5, the inner layer 10 of the top wall 20 may have a similar shape as the outer layer 20. The inner layer 10 may also comprise a plurality of teeth 15 in its perimeter region, wherein adjacent teeth 15 are separated by notches accordingly. Similar to the way the outer layer 20 is connected to the sidewall, the teeth 15 of the inner layer 10 may be folded or bent at a bending line 16 so that the perimeter region of the inner layer can be aligned in parallel to the sidewall 30 for connecting the inner layer 10 to the sidewall 30.

As illustrated in FIG. 4 and FIG. 5, that the inner layer 10 may comprise a venting hole 17 (see FIG. 5) and the outer layer 20 may comprise two venting holes 27 (see FIG. 4), wherein the venting holes 17, 27 of both the inner and outer layer 10, 20 may be arranged such that they do not overlap. This configuration can allow for venting of a container that is closed by the lid 1 wherein unwanted spilling of the contents of the container through the venting holes 17, 27 may be prevented.

According to certain embodiments of lid 1 (as shown in FIGS. 1-5), the inner layer 10 and/or the outer layer 20 and/or the sidewall 30 may made from paper or cardboard material or materials, including without limitation, biodegradable paper or biodegradable cardboard. According to certain embodiments, the inner layer 10 and/or the outer layer 20 and/or the sidewall 30 may be made from coated paper or coated cardboard, including without limitation, double side coated paper or double side coated cardboard. The coated paper or coated cardboard may comprise a coating including a biopolymer, such as polylactic acid (PLA). The sidewall 30 may be made from single side coated paper in certain embodiments.

According to certain embodiments of lid 1, as shown in FIGS. 1-5, the sidewall 30 of the lid 1 may be made from a sheet of paper or cardboard that has a curved shape with constant width, so that joining the smaller ends of the sheet results in a conical sidewall 30 as depicted in FIG. 1. Alternatively, the sidewall 30 can be made from a rectangular sheet of paper or cardboard, so that joining the smaller ends of the sheet results in a cylindrical sidewall.

Figure 6:
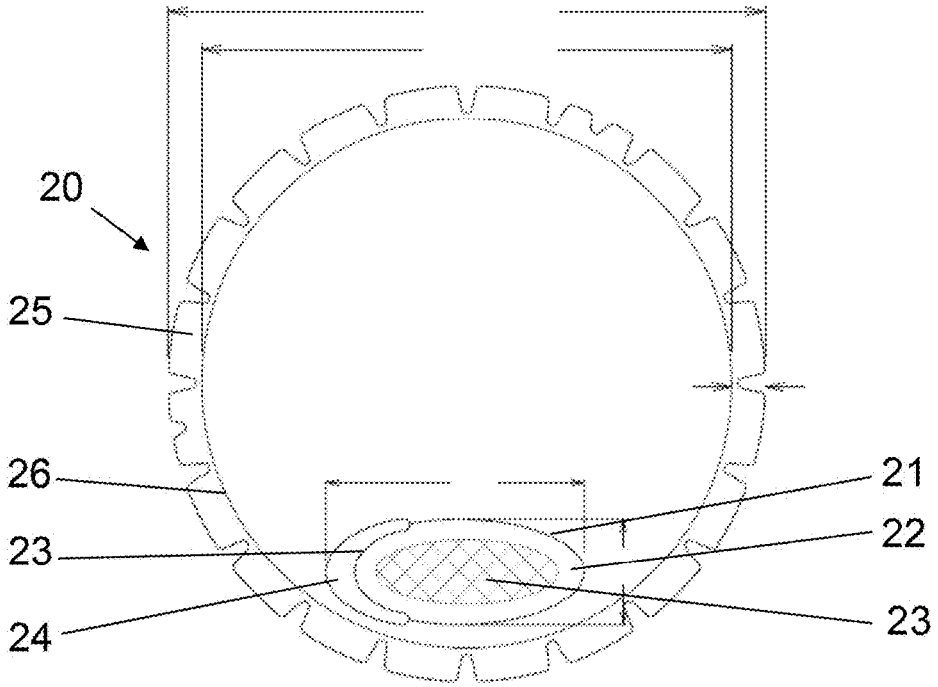
FIG. 6 is a plan view of a lid according to a second embodiment of the invention, illustrating an outer layer of a top wall of the lid.
Figure 7:
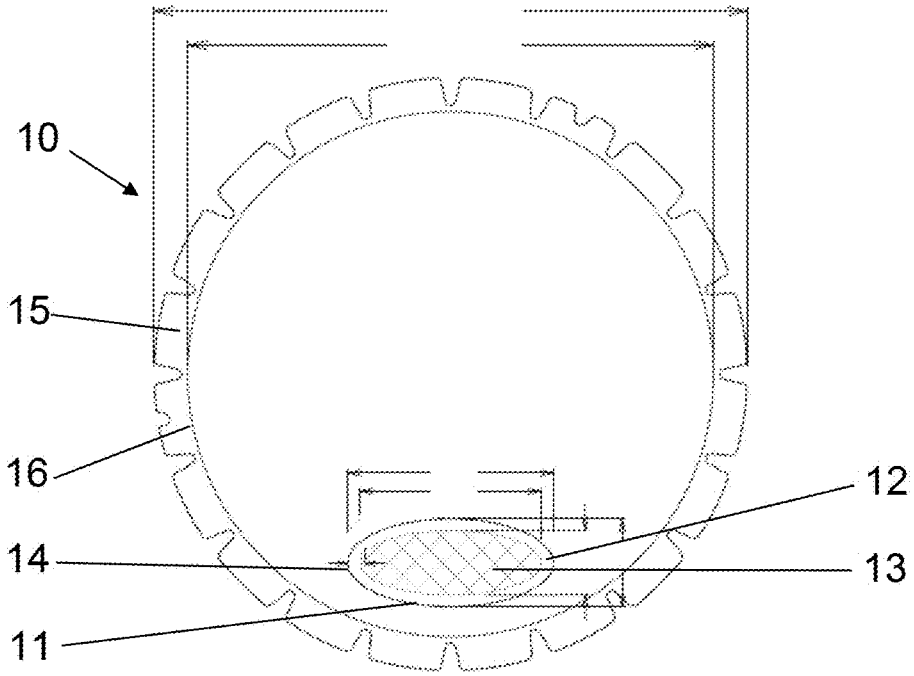
FIG. 7 is a plan view of the lid according to the second embodiment of the invention, illustrating an inner layer of the top wall of the lid.

FIG. 6 shows an outer layer 20 of the top wall 2 of a lid 1 according to a second embodiment of the invention, and FIG. 7 shows the corresponding inner layer 10 of the top wall 2 of the lid 1 according to the second embodiment of the invention. The second embodiment of lid 1 may be similar to the first embodiment of lid 1 as described above, and elements with identical functions may be labelled by identical reference numbers. In contrast to the first embodiment of lid 1, the tear-off area 22 of lid 1 according to the second embodiment may have an oval shape with a cut out at the side facing the grip recess 24. Due to this cut out, the grip recess 24 of the second embodiment may be enlarged as compared to the first embodiment of lid 1.

Additionally, according to the second embodiment of lid 1, the first perforation line 11 of the inner layer 10, in a section 14 of the openable sip hole area 12 facing the grip recess 24, may comprise a larger perforation element than in a section of the openable sip hole area 12 oriented away from the grip recess 24. The larger perforation element may be provided as a cut line that facilitates removal of the sip hole area 12 when the sip hole area 12 is pulled by tearing off the tear-off area 22.

The lids 1 according to the first and second embodiments do not require a separate paper strip to be connected to the outside of the top wall 2. Rather, the sip hole 50 in the inner layer 10 can be reliably opened by tearing off the outer layer 20 of the top wall 2 of the lid as will be described with reference to FIG. 8-11.

Figure 8:
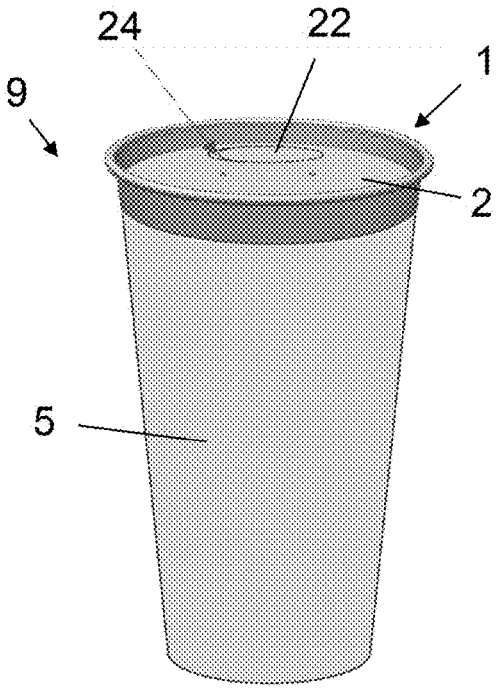
FIG. 8 is a perspective view a package with a container and the lid according to the first embodiment, illustrating the lid in a closed configuration.

FIG. 8 shows a package 9 comprising a container 5, which may be in the form of a paper cup for beverages, and a lid 1 covering an opening of the container 5. The lid 1 may be configured according to the first embodiment described above. The lid 1 may comprise a grip recess 24 in the outer layer 20 of the top wall 2.

Figure 9:
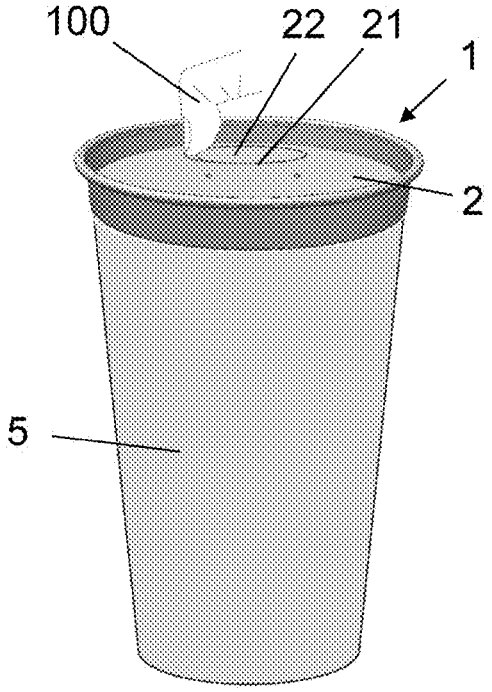
FIG. 9 is a perspective view of the package of FIG. 8, illustrating a finger grabbing into a grip recess.

As shown in FIG. 9, the fingertip 100 of a user may be partly introduced into the grip recess 24 so that the fingertip 100 contacts the edge of tear-off area 22 that is adjacent the grip recess 24. The fingertip 100 may lift the tear-off area 22 starting from the edge adjacent the grip recess 24 so that the perforation line 21 in the outer layer opens.

Pulling the tear-off area 24 away from the outer layer 20 of the top wall 22 may be continued. FIG. 10 illustrates a partially opened configuration of lid 1 wherein the tear-off area 24 is partly removed from the top wall 2 and partly still is connected to the top wall 2. Because of the connection of the outer wall 20 and the inner wall 10 in the tear-off area 22 and sip hole area 12, the sip hole area 12 may be removed from the top wall 2 together with the tear-off area 22. The perforation line 11 in the inner layer may be opened thereby creating a sip hole 50 in the inner layer of the top wall 2.

FIG. 11 shows the package 9 and lid 1 in a fully opened configuration wherein the sip hole area 12 and the tear-off area 22 are completely removed from the top wall 2 of the lid 1. A sip hole 50 remains in the top wall 2 that allows a user to drink a beverage from the container 5 with the lid 1 attached to the container 5.

Figure 12:
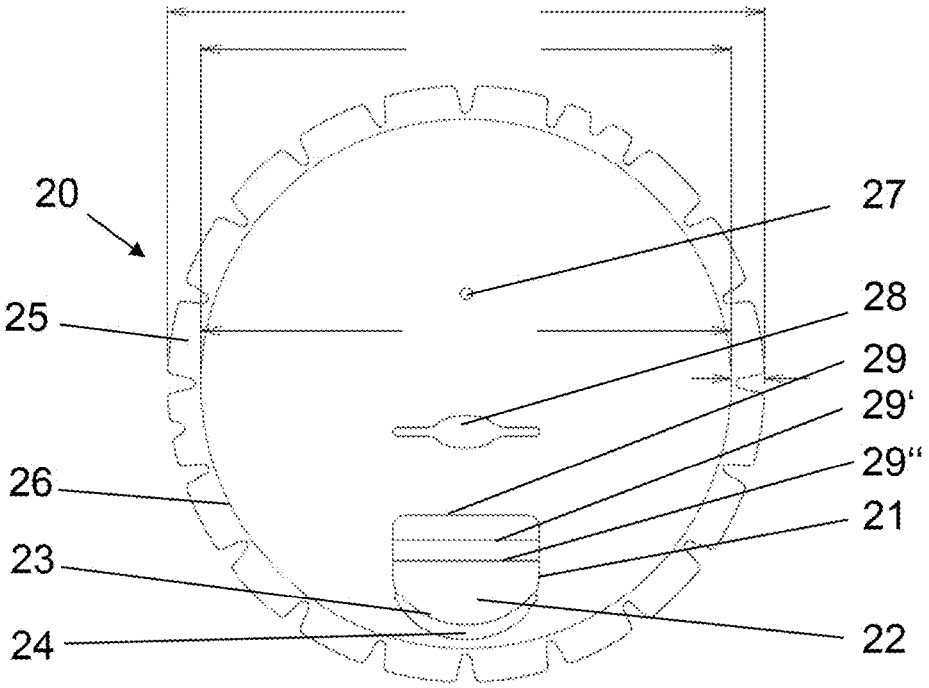
FIG. 12 is a top plan view of a lid according to a third embodiment of the invention, illustrating an outer layer of a top wall of the lid.
Figure 13:
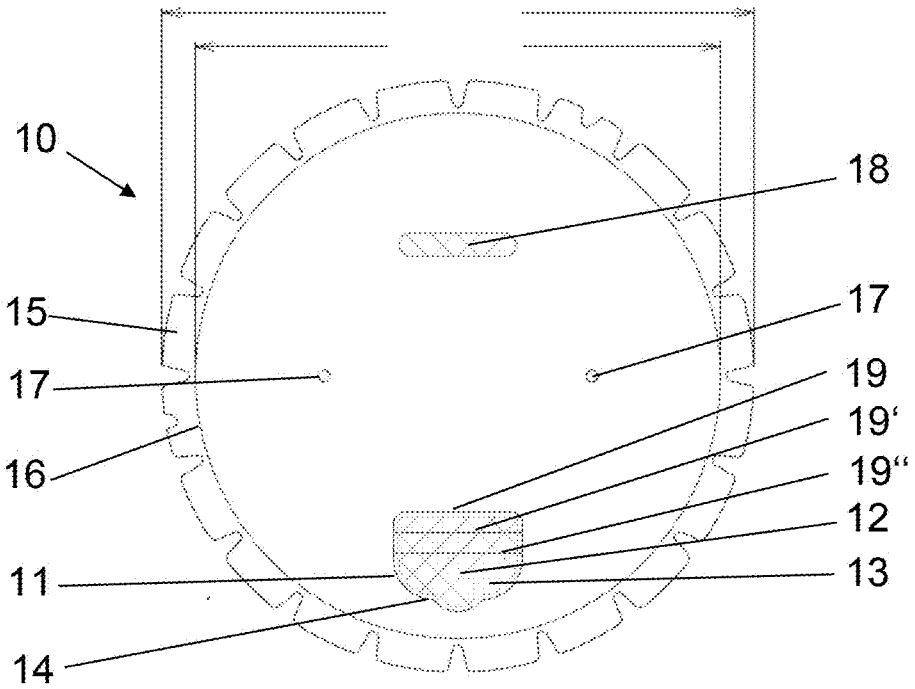
FIG. 13 is a top plan view of the lid according to the third embodiment, illustrating an inner layer of the top wall of the lid.

FIGS. 12 and 13 illustrate the lid 1 according to a third embodiment of the invention. FIG. 12 shows the outer layer 20 of the top wall 2 of the lid 1, and FIG. 13 shows the corresponding inner layer 10 of the top wall 2 of the lid. A sectional view of the lid 1 according to the third embodiments is equivalent to the lid 1 as shown in FIG. 2. The third embodiment of the lid 1 is similar to the first embodiment of the lid 1 as described above, and elements with identical functions are labelled by identical reference signs. The lid 1 according to the third embodiment may include a tear-off area 22 that may be configured with a closed U-shape. The connection section between the legs of the U-shape of the tear-off area 22 may face a grip recess 24. The grip recess 24 of the lid 1, according to the third embodiment, may have an arcuate shape.

The lid 1 according to the third embodiment may comprise a perforation line 21 with a first and a second perforation line end, wherein the first and second perforation line ends may each connect to a common crease line 29. The perforation line 21 and the crease line 29 may collectively define the tear-off area 22 of the outer layer 20. Furthermore, two additional crease lines 29' and 29" may be arranged in parallel to the crease line 29 in the tear-off area 22. The outer layer 20 may further comprise a slot 28 that may be arranged in parallel to the crease line 29. The slot 28 may be arranged such that a portion of the tear-off area 22 may be inserted into the slot 28 after separating the portion from the outer layer 20 and/or bending the tear-off area around the crease line 29. To facilitate introducing the tear-off area 22 into the slot, the slot 28 may have a width and two endings, wherein the width of the slot 28 may be smaller at the endings than at the middle of the slot 28. When the tear-off area 22 is partially inserted into the slot 28, the portion of the tear-off are 28 can rest in between the inner layer 10 and the outer layer 20.

The first perforation line 11 of the inner layer 10, in a section 14 of the openable sip hole area 12 facing the grip recess 24, may comprise a bulge directed towards the grip recess 24. The perforation line 11 may include a large perforation element in a section of the openable sip hole area oriented away from the grip recess 24. The larger perforation element may be configured as a cut line that facilitates removal of the sip hole area 12 when the sip hole area 12 is pulled by tearing off the tear-off area 22.

Similar to the outer layer 20, the inner layer 10 according to the third embodiment of lid 1 may include a perforation line 11 with a first and a second perforation line end, wherein the first and a second perforation line ends may each connect to a common crease line 19. The perforation line 11 and the crease line 19 may collectively define the openable sip hole off area 12 of the inner layer 10. Furthermore, two additional crease lines 19' and 19" may be arranged in parallel to the crease line 19 in the openable sip hole area 12. The inner layer 10 may include an additional connection area 18 in which the inner layer 10 and the outer layer 20 are connected.

Figure 14:
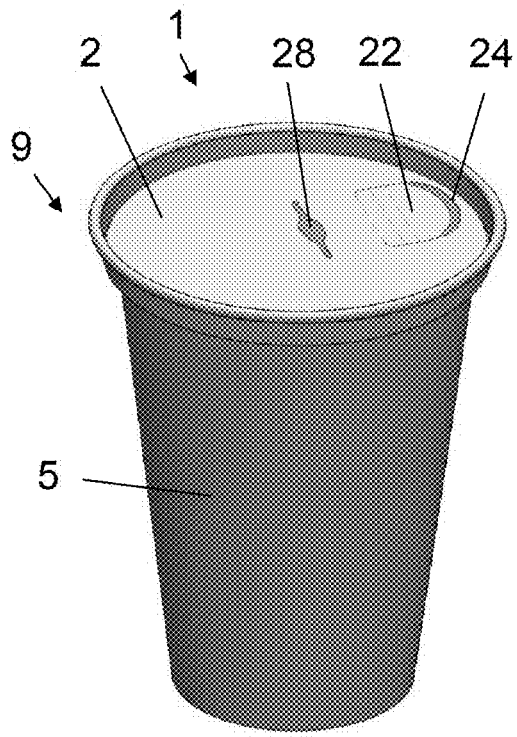
FIG. 14 is a perspective view a package with a container and the lid according to the third embodiment of the invention, illustrating the lid in a closed configuration.

FIG. 14 shows a package 9 comprising a container 5, which may be in the form of a paper cup for beverages, and a lid 1 covering an opening of the container 5. The lid 1 may be configured according to the third embodiment described above. The lid 1 may comprise a grip recess 24 in the outer layer 20 of the top wall 2.

Figure 15:
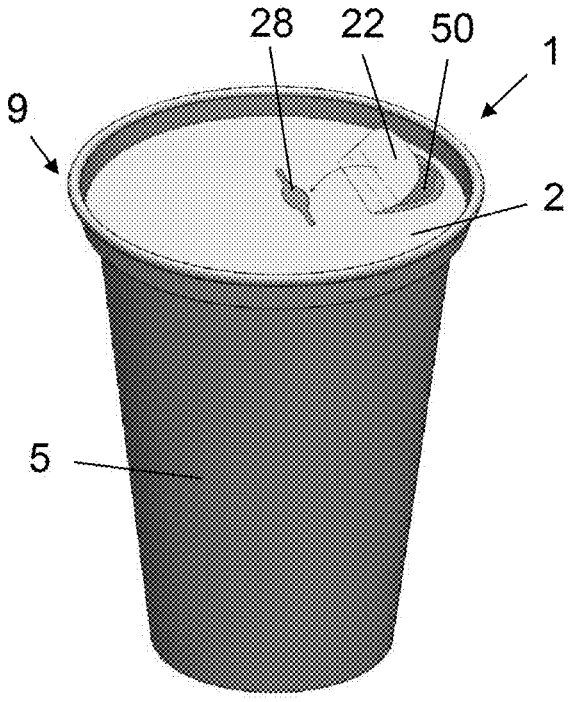
FIG. 15 is a perspective view of the package of FIG. 14, illustrating the lid in a partially opened configuration.
Figure 16:
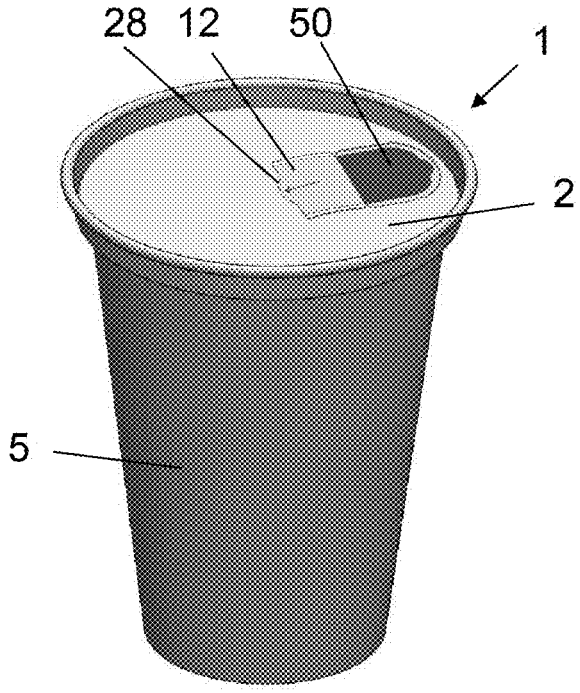
FIG. 16 is a perspective view of the package of FIG. 14, illustrating the lid in a fully opened configuration.

As shown in FIG. 15 the tear-off area 22 may be lifted so that the perforation line 21 in the outer layer opens. Pulling the tear-off area 24 away from the outer layer 20 of the top wall 22 is continued may be continued. FIG. 16 shows a partially opened configuration of lid 1 wherein the tear-off area 24 is partly removed from the top wall 2 and partly still is connected to the top wall 2. Because of the connection of the outer wall 20 and the inner wall 10 in the tear-off area 22 and sip hole area 12, the sip hole area 12 may be removed from the top wall 2 together with the tear-off area 22. The perforation line 11 in the inner layer is opened thereby creating a sip hole 50 in the inner layer of the top wall 2. As shown in FIG. 16, the portion of the tear-off area 22 that formerly was situated next to the grip recess 24 may be positioned into the slot 28 in the outer layer 20.

Figure 17:
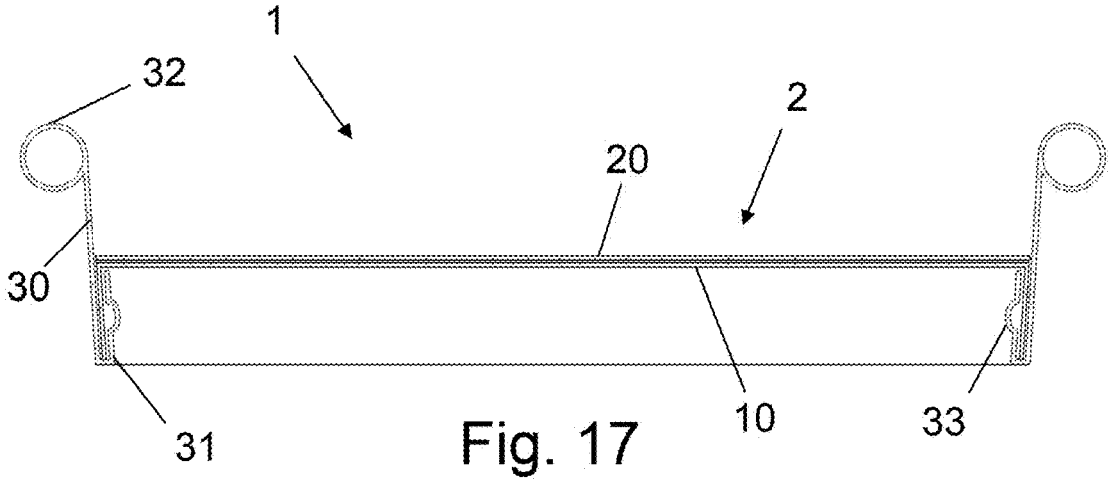
FIG. 17 is a sectional side view of a lid according to a fourth embodiment of the invention.

FIG. 17 shows a sectional view of a lid 1 according to a fourth embodiment of the invention. The lid 1 may comprise a top wall 2 and a sidewall 30 connected to the top wall 2. The top wall 2 may have a circular shape with a perimeter that is connected to the sidewall 30 of the lid 2. The sidewall 30 may have a top edge that is provided as a folded or bent edge 32, which may be configured as a rolled edge. Additionally, the sidewall 30 may comprise a lower edge that may be provided as a folded or bent edge 31. The sidewall 30 may have a conical shape, wherein the diameter of the sidewall 30 is larger at the top bent edge 32 of the sidewall 30 than at a lower bent edge 31 of the sidewall 30. Alternatively, the sidewall 30 may have a cylindrical shape, wherein the diameter of the sidewall 30 at the top bent edge 32 of the sidewall 30 is approximately equal to the diameter at a lower bent edge 31 of the sidewall 30. The top wall 2 may be configured as a multi-layered top wall. The top wall of lid 1 may include an inner layer 10 and an outer layer 20. When the lid 1 is connected to a container, the inner layer 10 may be directed toward the interior of the container and the outer layer 20 may be directed away from the interior of the container. The inner layer 10 of the top wall 2 may be folded or bent at its perimeter so as to fit closely to the inside of sidewall 30. The lower bent edge 31 of the inner layer 10 may be wrapped around the perimeter of the top wall 2 to form a connection between the top wall 2 and the sidewall 30. The sidewall 30 may comprise an inward-looking bead 33 for locking the lid 2 at a mouth roll of a cup. The bead 33 may be configured as a protrusion in the sidewall 30. The protrusion may be annular or may be configured as separate protrusion elements. The outer layer 20 of the top wall 2 may have a plain circular shape. As shown in FIG. 17, in contrast to the inner layer 10, the outer layer 20 is not bent at its perimeter. Rather, the peripheral circular edge of the outer layer 20 is in contact with the inside of the sidewall 30.

Figure 18:
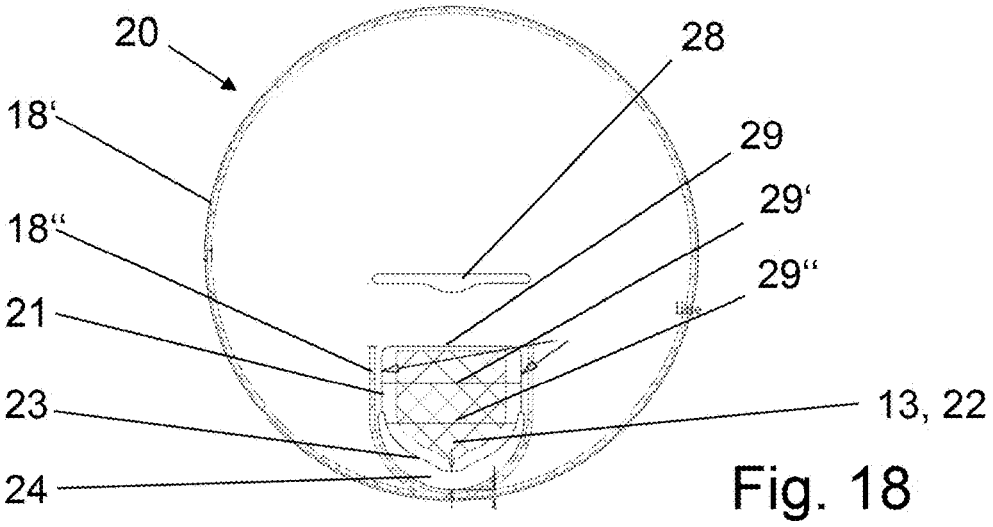
FIG. 18 is a top plan view of the lid of FIG. 17, illustrating an outer layer of a top wall of the lid.
Figure 19:
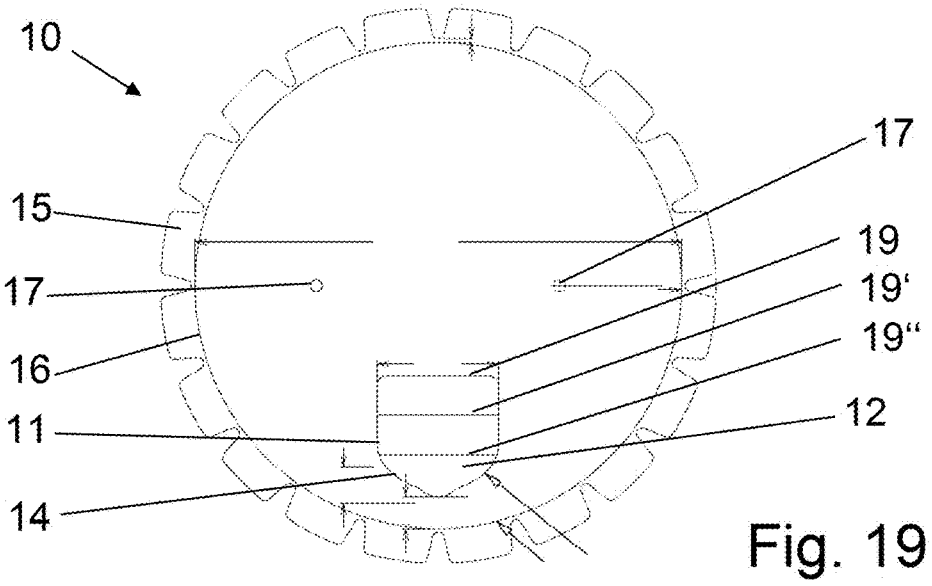
FIG. 19 is a top plan view of the lid of FIG. 17, illustrating an inner layer of the top wall of the lid.

FIG. 18 shows the outer layer 20 of the top wall 2 of the lid 1 according to the fourth embodiment of the invention, and FIG. 19 shows the corresponding inner layer 10 of the top wall 2 of the lid 1 according to the fourth embodiment of the invention. The fourth embodiment of lid 1 may be similar to the third embodiment of lid 1 as described above, and elements with identical functions are labelled by identical reference signs. According to the fourth embodiment, the outer layer 20 of the top wall 2 of the lid 1 in not bent at its perimeter. Instead, the outer layer 20 may be connected to the inner layer 10 at the edge, in particular the perimeter, of the outer layer 20 by an adhesive bond and/or connected by a heat-sealed connection and/or connected by a welded joint thereby forming another connection area 18' as shown in FIGS. 17 and 18.

As shown in FIG. 18, the tear-off area 22 of the lid 1 according to the fourth embodiment may be in the form of a closed U-shape. As shown, the connection section between the legs of the U-shape tear-off area 22 can face a grip recess 24. The grip recess 24 may have an arcuate shape. The outer layer 20 may comprise a perforation line 21 with a first and a second perforation line end, wherein the first and a second perforation line ends each connect to a common crease line 29. The perforation line 21 and the crease line 29 can collectively define the tear-off area 22 of the outer layer 20. Furthermore, two additional crease lines 29' and 29" may be provided and arranged in parallel to the crease line 29 in the tear-off area 22. The outer layer 20 may further comprise a slot 28 that may be arranged in parallel to the crease line 29. The slot 28 may be positioned such that a portion of the tear-off area 22 may be inserted into the slot 28 after separating the portion from the outer layer 20 and/or bending the tear-off area around the crease line 29. To facilitate introducing the tear-off area 22 into the slot, the slot 28 can have a width and two endings, wherein the width of the slot 28 is smaller at the endings than at the middle of the slot 28. When the tear-off area 22 is partially inserted into the slot 28, the portion of the tear-off area 28 may rest in between the inner layer 10 and the outer layer 20.

Similar to the outer layer 20, the inner layer 10 of the lid 1 according to the fourth embodiment may include a perforation line 11 with a first and a second perforation line end, wherein the first and a second perforation line ends may each connect to a common crease line 19. The perforation line 11 and the crease line 19 may collectively define the openable sip hole off area 12 of the inner layer 10. Furthermore, two additional crease lines 19' and 19" may be provided and arranged in parallel to the crease line 19 in the openable sip hole area 12.

The outer layer 20 is not connected to the inner layer 10 in the area of the first and second perforation lines 11, 21. The inner layer 10 may be connected to the outer layer 20 in an area surrounding the first and second perforation lines 11, 21 by an additional connection area 18". The additional connection area 18" may be provided in the form of a connection line that runs in parallel to the first and second perforation lines 11, 21. In the additional connection area 18", the inner layer 10 and the outer layer 20 may be connected by an adhesive bond and/or connected by a heat-sealed connection and/or connected by a welded joint.

The lid 1 according to the fourth embodiment can be used as described in connection with the third embodiment and FIGS. 14-16.

Figure 20:
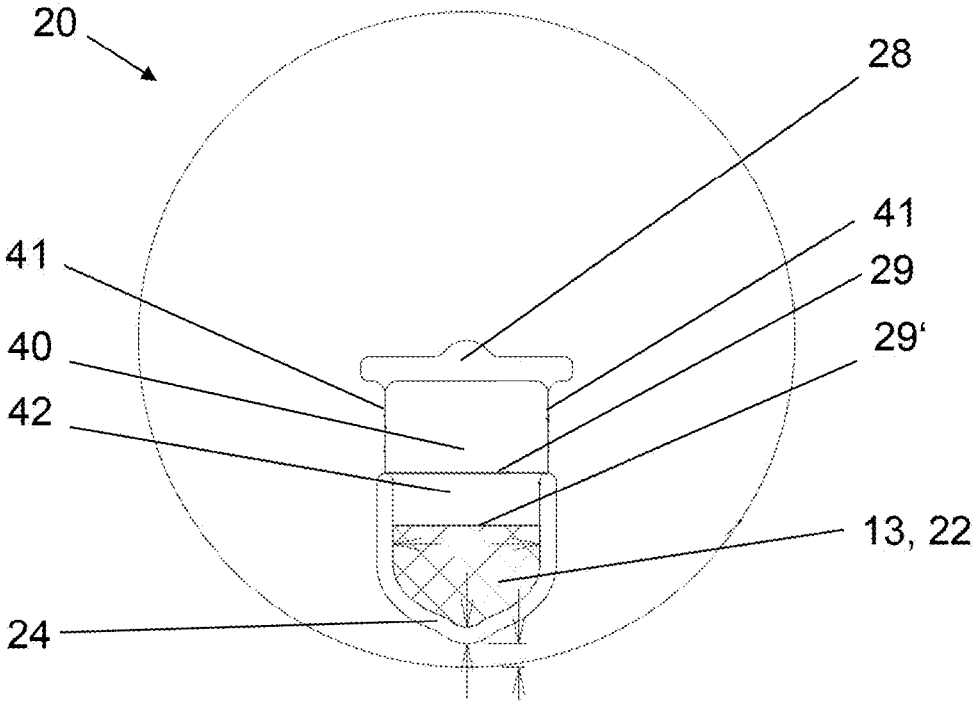
FIG. 20 is a top plan view of a lid according to a fifth embodiment of the invention, illustrating an outer layer of a top wall of the lid.
Figure 21:
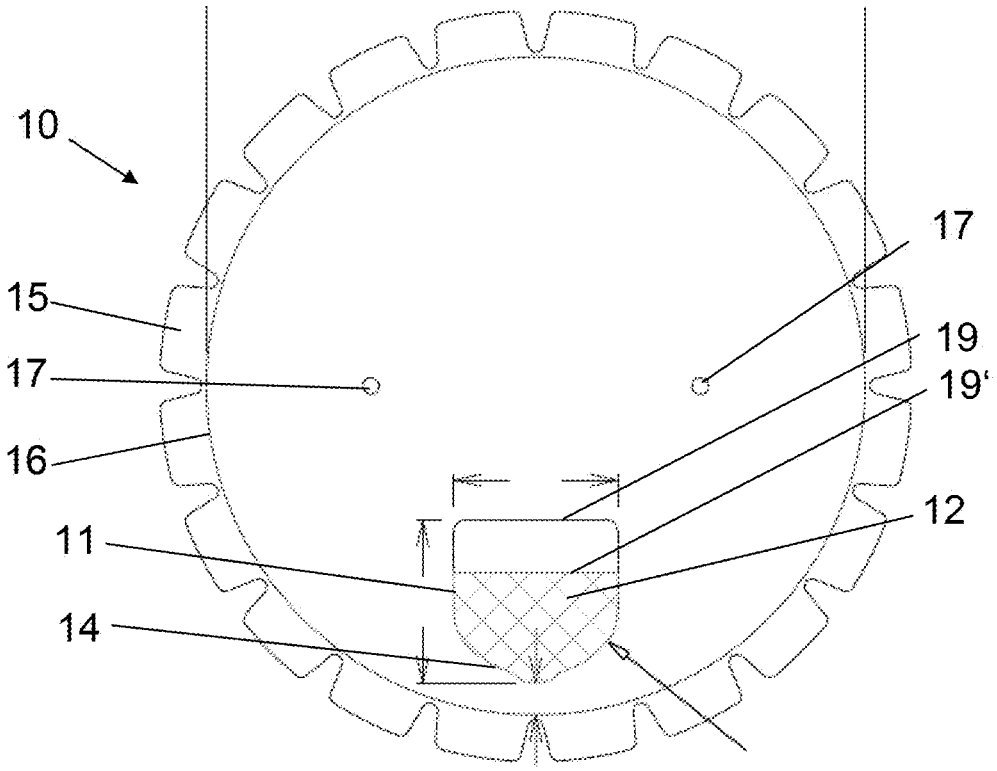
FIG. 21 is a top plan view of the lid according to the fifth embodiment of the invention, illustrating an inner layer of the top wall of the lid.
Figure 22:
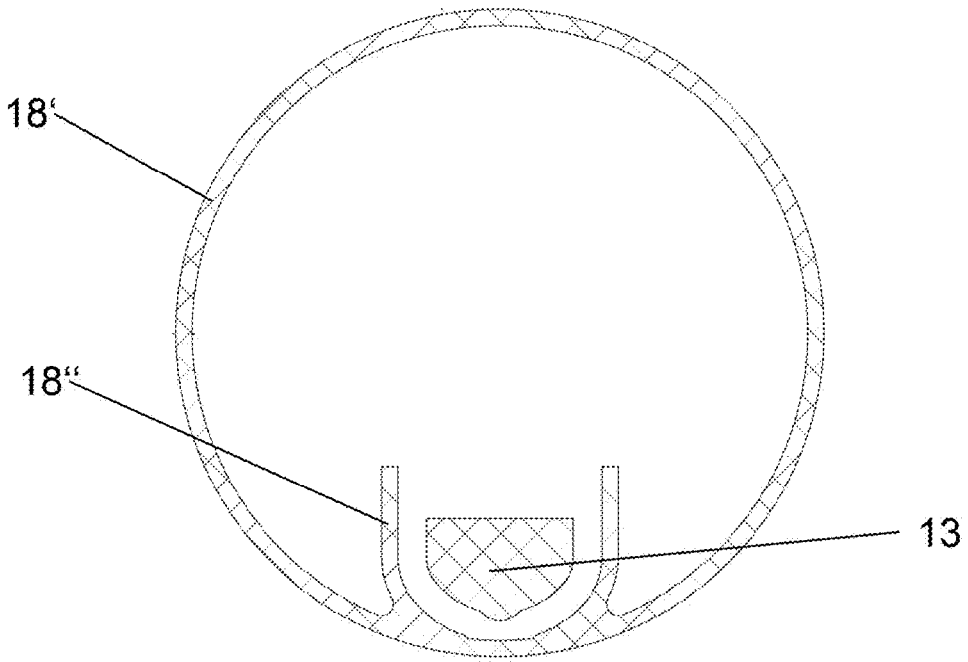
FIG. 22 is a schematic top view of the lid according to the fifth embodiment of the invention, illustrating a schematic connection scheme for the top wall of the lid.

FIGS. 20-22 illustrate the lid 1 according to a fifth embodiment of the invention. FIG. 20 shows the outer layer 20 of the top wall 2 of the lid 1 according to the fifth embodiment, and FIG. 21 shows the corresponding inner layer 10 of the top wall 2 of the lid 1. FIG. 22 provides a schematic representation of a connection scheme of the inner and outer layers 10 and 20 of lid 1 according to a particular embodiment. A sectional view of the lid 1 according to the fifth embodiment may be equivalent to the lid 1 as shown in FIG. 17. The lid 1 of the fifth embodiment may be similar to the lid 1 of the fourth embodiment as described above and elements with identical functions are labelled by identical reference signs. The outer layer 20 of the lid 1 according to the fifth embodiment may comprise a tear-off area 22 that may be defined by a gripping recess 22 in the form of a U-shaped cut out and a crease line 29 that is arranged between the legs of the U-shaped gripping area 22. The outer layer 20 may further comprise a pull tab 40 that may be defined between the slot 28 and the tear-off area 22 by two perforation lines 41. The perforation lines 41 may be arranged in parallel both starting from the gripping recess or U-shaped cut-out 22 and ending at the slot 28. An intermediate tab 42 may be provided and arranged between the pull tab 40 and the tear-off area 22. A first crease line 29 may separate the pull tab from the intermediate tab 42. A second crease line 29' may separate the intermediate tab from the tear-off area 22. In contrast to the tear-off area 22, which may be connected to the inner layer 10, the intermediate tab 42 and the pull tab are both not connected to the inner layer 10.

Figure 23:
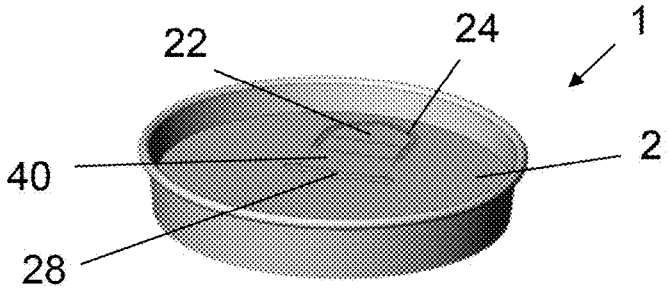
FIG. 23 is a perspective view of the lid according to the fifth embodiment of the invention, illustrating the lid in a closed configuration.
Figure 24:
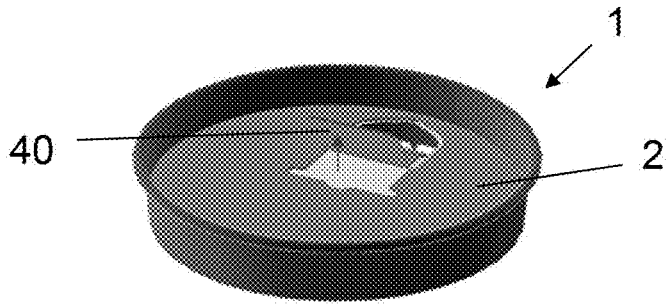
FIG. 24 is a perspective view of the lid of FIG. 23, illustrating the lid in a first partially opened configuration.
Figure 25:
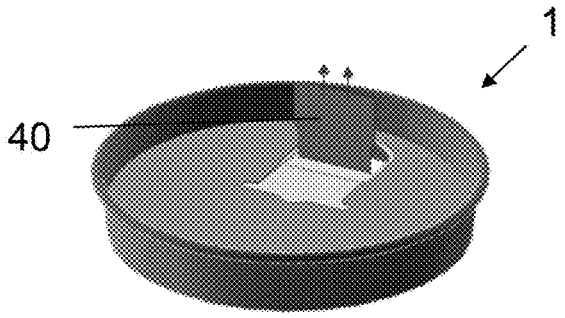
FIG. 25 is a perspective view of the lid of FIG. 23, illustrating the lid in a second partially opened configuration.
Figure 26:
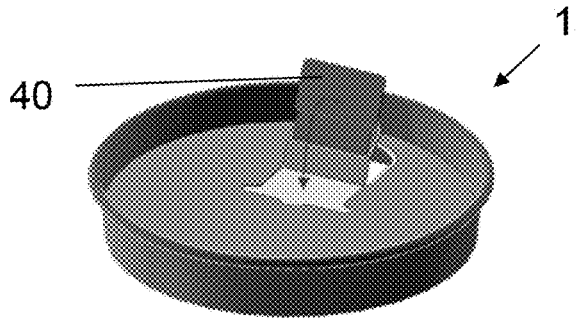
FIG. 26 is a perspective view of the lid of FIG. 23, illustrating the lid in a third partially opened configuration.
Figure 27:
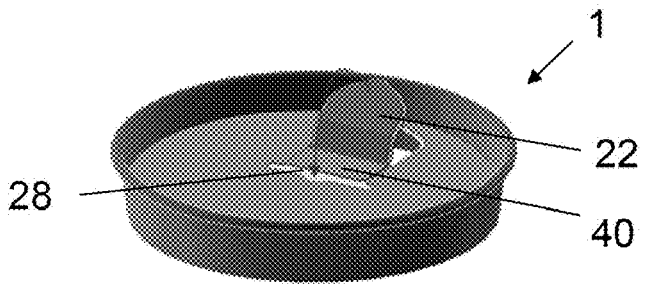
FIG. 27 is a perspective view of the lid of FIG. 23, illustrating the lid in a fourth partially opened configuration.
Figure 28:
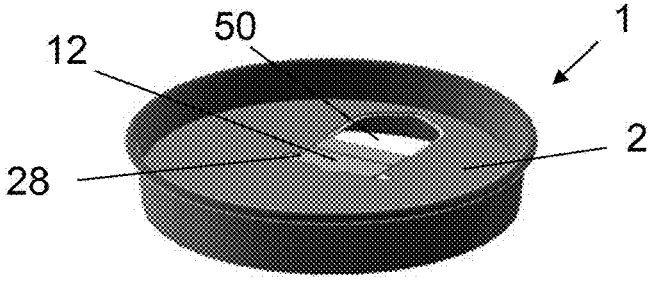
FIG. 28 is a perspective view of the lid of FIG. 23, illustrating the lid in a fully opened configuration.

FIG. 23 shows the lid 1 according to the fifth embodiment, which may be configured for covering an opening of a container, wherein the lid 1 is in a closed configuration. The lid 1 may comprise a grip recess 24 in the outer layer 20 of the top wall 2. As shown in FIG. 24, the pull tab 40 may be lifted and simultaneously the tear-off area 22 may be pushed down toward the inner layer 10 so that the perforation line 21 in the outer layer and the perforation line 11 in the inner layer 10 opens. Then, as shown in FIG. 25, the pull tab 40 may be lifted up, so that the tear-off are 22 is also pulled upward. As shown in FIG. 26, the pull tab 40 may be folded back down toward its original position in the closed configuration of the lid 1. The tear-off area 22 may be introduced into the slot 28 (see FIG. 27) so that the tear-off area 24 may be partly tucked into the slot 28 (see FIG. 28). The connection of the outer wall 20 and the inner wall 10 in the tear-off area 22 and sip hole area 12 may allow the sip hole area 12 to be removed from the top wall 2 together with the tear-off area 22. The perforation line 11 in the inner layer is opened thereby creating a sip hole 50 in the inner layer of the top wall 2. The portion of the tear-off area 22 that formerly has been situated next to the grip recess 24 may now be introduced into the slot 28 in the outer layer 20.

Figure 29:
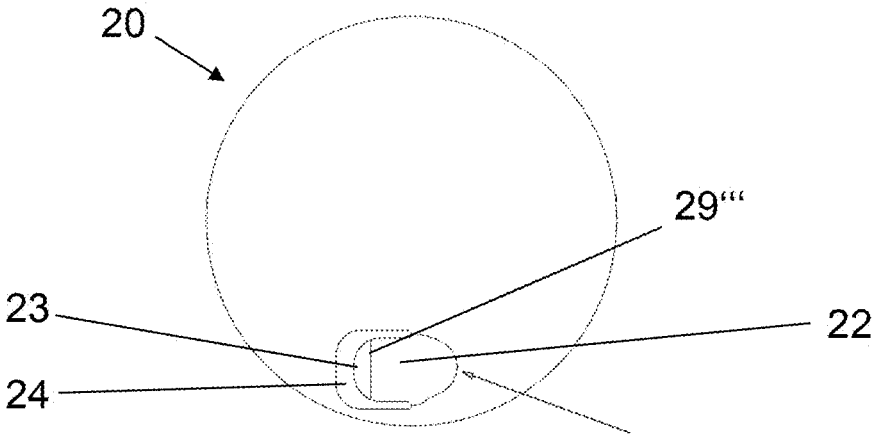
FIG. 29 is a top plan view of a lid according to a sixth embodiment of the invention, illustrating an outer layer of a top wall of the lid.
Figure 30:
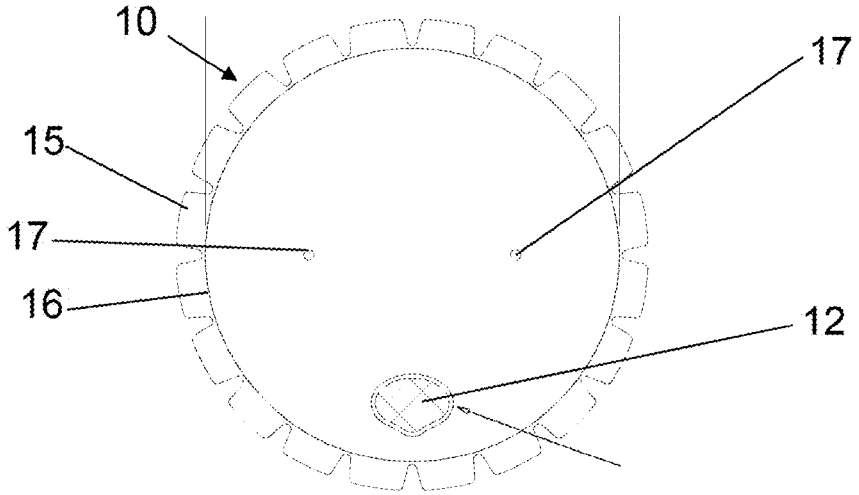
FIG. 30 is a top plan view of the lid according to the sixth embodiment of the invention, illustrating an inner layer of the top wall of the lid.
Figure 31:
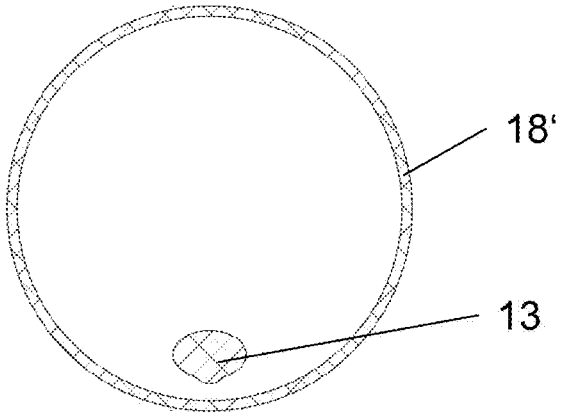
FIG. 31 is a schematic top view of the lid according to the sixth embodiment of the invention, illustrating a schematic connection scheme for the top wall of the lid.

FIGS. 29-31 illustrate the lid 1 according to a sixth embodiment of the invention. FIG. 29 shows the outer layer 20 of the top wall 2 of the lid 1 according to the sixth embodiment, and FIG. 30 shows the corresponding inner layer 10 of the top wall 2 of the lid 1. A sectional view of the lid 1 according to the sixth embodiment may be equivalent to the illustration of the lid 1 shown in FIG. 17. The lid 1 of the sixth embodiment may be similar to the lid 1 of the second embodiment as described above and elements with identical functions are labelled by identical reference signs. The tear-off area 22 of the lid 1 according to the sixth embodiment may comprise an intermediate crease line 29'". The intermediate crease line 29'" together with the second perforation line may define a gripping tab as part of the tear-off area 22. The gripping tab of the outer layer 20 is not connected to the inner layer and, thus, may be gripped by a finger approaching from the grip-recess 24. Consequently, the gripping tab may facilitate tearing off of the tear-off area 22.

As shown in FIG. 31, the outer layer 20 may be connected to the inner layer 10 in an additional connection area 18' at the perimeter of the outer layer 20. The additional connection area 18' may be an adhesive bond, and/or a heat-sealed connection, and/or a welded joint. The connection area 18' may be configured as a ring-shaped area.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention.

What is claimed is:

1. A lid for a container, the lid comprising:

a top wall for covering an opening of the container, wherein the top wall comprises an inner layer and an outer layer;

wherein the inner layer comprises a first perforation line defining an openable sip hole area;

wherein the outer layer is connected to the inner layer at a first location;

wherein the first location is the openable sip hole area so that tearing off at least a part of the outer layer results in opening of the first perforation line to create a sip hole in the inner layer;

wherein the outer layer is connected to the inner layer at a second location;

wherein the second location is the perimeter of the inner layer; and wherein the outer layer is not connected to the inner layer in at least both of a first area surrounding the openable sip hole area and a second area inside the perimeter of the inner layer so that the outer layer is only connected to the inner layer at the first and second locations.

2. The lid of claim 1, wherein the outer layer is connected to the inner layer at the openable sip hole area by at least one of an adhesive bond, a heat-sealed connection, a welded joint, and an ultrasonic welded joint.

3. The lid of claim 1, wherein the outer layer comprises a second perforation line defining a tear-off area, wherein the tear-off area is connected to the openable sip hole area of the inner layer.

4. The lid of claim 3, wherein the second perforation line has a third perforation line end and a fourth perforation line end, wherein the third perforation line end and the fourth perforation line end of the second perforation line connect to a common second crease line.

5. The lid of claim 1, wherein the outer layer comprises a tear-off area that is at least partly defined by at least one of a cut line and a cut-out.

6. The lid of claim 3, wherein the tear-off area is larger than the sip hole area.

7. The lid of claim 6, wherein the tear-off area is arranged to completely cover the sip hole area.

8. The lid of claim 3, wherein the outer layer comprises a grip recess that is arranged adjacent the tear-off area.

9. The lid of claim 3, wherein the outer layer comprises an intermediate crease line situated in the tear-off area, wherein the second perforation line and the intermediate crease line define a gripping tab.

10. The lid of claim 8, wherein the openable sip hole area of the inner layer is arranged within in a distance from the grip recess, wherein the distance is at least 1 mm.

11. The lid of claim 10, wherein the distance is at least 3 mm.

12. The lid of claim 1, wherein the first perforation line is a closed perforation line, and wherein the first perforation line is at least one of an oval perforation line and a circular perforation line.

13. The lid of claim 1, wherein the first perforation line has a first perforation line end and a second perforation line end, wherein the first perforation line end and the second perforation line end connect to a common first crease line.

14. The lid of claim 3, wherein the outer layer comprises a slot arranged such that a portion of the tear-off area may be inserted into the slot after separating the portion from the outer layer.

15. The lid of claim 1, wherein the lid comprises a sidewall arranged at an angle with respect to the top wall, wherein both the inner layer and the outer layer of the top wall are connected to the sidewall, wherein the sidewall comprises a first bent edge, wherein both the inner layer and the outer layer of the top wall are wrapped by the first bent edge.

16. The lid of claim 1, wherein the lid comprises a sidewall arranged at an angle with respect to the top wall, wherein the inner layer of the top wall is connected to the sidewall, wherein the sidewall comprises a first bent edge, wherein the inner layer of the top wall is wrapped by the first bent edge, wherein the outer layer of the top wall is a plane layer that is connected only to a surface of the inner layer that is facing the outer layer but not connected to the sidewall.

17. The lid of claim 1, wherein at least one of the inner layer and the outer layer is made from at least one of paper, cardboard, biodegradable paper, and biodegradable cardboard.

18. The lid of claim 1, wherein the inner layer includes a first venting hole and the outer layer includes a second venting hole, wherein the first and second venting holes do not overlap and are arranged within a distance from each other.

19. A package comprising a container and a lid, wherein the lid comprises:

a top wall for covering an opening of the container, wherein the top wall comprises an inner layer and an outer layer;

wherein the inner layer comprises a first perforation line defining an openable sip hole area;

wherein the outer layer is connected to the inner layer at a first location;

wherein the first location is at the openable sip hole area so that tearing off at least a part of the outer layer results in opening of the first perforation line to create a sip hole in the inner layer;

wherein the outer layer is connected to the inner layer at a second location;

wherein the second location is the perimeter of the inner layer; and wherein the outer layer is not connected to the inner layer in at least one both of a first area surrounding the openable sip hole area and a second area inside the perimeter of the inner layer so that the outer layer is only connected to the inner layer at the first and second locations.

20. A method for manufacturing a lid for a container, the method comprising:

providing a top wall for covering an opening of the container, wherein the top wall comprises an inner layer and an outer layer;

creating a first perforation line in the inner layer, wherein the first perforation line defines an openable sip hole area;

arranging the outer layer on top of the inner layer; and connecting the outer layer to the inner layer at:

a first location, wherein the first location is the openable sip hole area so that tearing off at least a part of the outer layer results in opening of the first perforation line to create a sip hole in the inner layer, a second location, wherein the second location is the perimeter of the inner layer, and wherein the outer layer is not connected to the inner layer in at least one both of a first area surrounding the openable sip hole area and a second area inside the perimeter of the inner layer so that the outer layer is only connected to the inner layer at the first and second locations.

* * * * *